US008888563B2

(12) United States Patent
Moriya

(10) Patent No.: US 8,888,563 B2
(45) Date of Patent: Nov. 18, 2014

(54) POLISHING HEAD CAPABLE OF CONTINUOUSLY VARYING PRESSURE DISTRIBUTION BETWEEN PRESSURE REGIONS FOR UNIFORM POLISHING

(75) Inventor: Norihiko Moriya, Nagano (JP)

(73) Assignee: Fujikoshi Machinery Corp., Nagano (JP)

( * ) Notice: Subject to any disclaimer, the term of this patent is extended or adjusted under 35 U.S.C. 154(b) by 359 days.

(21) Appl. No.: 13/195,220

(22) Filed: Aug. 1, 2011

(65) Prior Publication Data

US 2012/0052774 A1 Mar. 1, 2012

(30) Foreign Application Priority Data

Aug. 31, 2010 (JP) ..... 2010-193124

(51) Int. Cl.
*B24B 29/00* (2006.01)
*B24B 37/30* (2012.01)

(52) U.S. Cl.
CPC ..... *B24B 37/30* (2013.01)
USPC ..... 451/288; 451/287

(58) Field of Classification Search
USPC ..... 451/288, 41, 8, 287, 289, 398
See application file for complete search history.

(56) References Cited

U.S. PATENT DOCUMENTS 3,571,978 A * 3/1971 Day et al. ..... 451/288
5,423,716 A * 6/1995 Strasbaugh ..... 451/388
5,635,083 A * 6/1997 Breivogel et al. ..... 216/88
6,152,808 A * 11/2000 Moore ..... 451/60
6,203,414 B1 * 3/2001 Numoto et al. ..... 451/288
6,210,255 B1 * 4/2001 Zuniga et al. ..... 451/41
6,283,834 B1 * 9/2001 Liauzu ..... 451/41
6,494,774 B1 * 12/2002 Zuniga et al. ..... 451/398
6,511,367 B2 * 1/2003 Zuniga et al. ..... 451/285
6,514,124 B1 * 2/2003 Zuniga et al. ..... 451/41
6,568,991 B2 * 5/2003 Herb et al. ..... 451/6
6,569,771 B2 * 5/2003 Lin et al. ..... 438/692
6,572,438 B2 * 6/2003 Numoto ..... 451/3
6,659,850 B2 * 12/2003 Korovin et al. ..... 451/286
6,695,687 B2 * 2/2004 Hollatz et al. ..... 451/288
6,729,946 B2 * 5/2004 Kimura ..... 451/388
6,746,318 B2 * 6/2004 Mallery et al. ..... 451/285
6,855,037 B2 * 2/2005 Ashjaee et al. ..... 451/57

(Continued)

FOREIGN PATENT DOCUMENTS

EP 1 582 294 A2 10/2005
JP 2002-187060 A 7/2002

(Continued)

*Primary Examiner* — Joseph J Hail
*Assistant Examiner* — Joel Crandall
(74) *Attorney, Agent, or Firm* — Birch, Stewart, Kolasch & Birch, LLP

(57) ABSTRACT

A polishing apparatus which includes a polishing head for holding a work, and a polishing plate on which a polishing pad is adhered. The polishing head includes a holding plate, an elastic sheet member fixed to an edge of the holding plate, a ring-shaped template fixed to an outer edge of a lower face of the elastic sheet member, a pressure chamber formed between a lower face of the holding plate and an upper face of the elastic sheet member, a seal ring having a main body part which is fitted to a supporting plate, a seal lip, which slidelingly contacts the elastic sheet member and divides the inside of the pressure chamber into an inner divided chamber and an outer divided chamber; and a fluid supply section for individually supplying a fluid to the divided chambers.

12 Claims, 4 Drawing Sheets

(56) References Cited

U.S. PATENT DOCUMENTS

| | | | | |
|---|---|---|---|---|
| 6,890,402 | B2 * | 5/2005 | Gunji et al. | 156/345.14 |
| 6,921,323 | B2 * | 7/2005 | Boo et al. | 451/288 |
| 6,939,206 | B2 * | 9/2005 | Ashjaee et al. | 451/41 |
| 6,945,861 | B2 * | 9/2005 | Boo et al. | 451/285 |
| 7,025,664 | B2 * | 4/2006 | Korovin et al. | 451/289 |
| 7,029,382 | B2 * | 4/2006 | Maloney et al. | 451/288 |
| 7,029,383 | B2 * | 4/2006 | Lee | 451/289 |
| 7,040,971 | B2 * | 5/2006 | Zuniga et al. | 451/288 |
| 7,081,045 | B2 * | 7/2006 | Boo et al. | 451/288 |
| 7,156,725 | B2 * | 1/2007 | Togawa et al. | 451/285 |
| 7,311,585 | B2 * | 12/2007 | Togawa et al. | 451/41 |
| 7,326,103 | B2 * | 2/2008 | Sakurai et al. | 451/10 |
| 7,357,699 | B2 * | 4/2008 | Togawa et al. | 451/288 |
| 7,527,271 | B2 * | 5/2009 | Oh et al. | 279/3 |
| 7,867,063 | B2 * | 1/2011 | Togawa et al. | 451/288 |
| 8,070,560 | B2 * | 12/2011 | Yasuda et al. | 451/289 |
| 8,268,114 | B2 * | 9/2012 | Masumura et al. | 156/345.12 |
| 2001/0011003 | A1 * | 8/2001 | Numoto | 451/379 |
| 2002/0111122 | A1 * | 8/2002 | Korovin et al. | 451/41 |
| 2003/0045205 | A1 * | 3/2003 | Herb et al. | 451/5 |
| 2004/0259476 | A1 * | 12/2004 | Korovin et al. | 451/6 |
| 2005/0153635 | A1 * | 7/2005 | Boo et al. | 451/285 |
| 2007/0232209 | A1 * | 10/2007 | Boo et al. | 451/388 |
| 2008/0299880 | A1 * | 12/2008 | Gunji et al. | 451/385 |
| 2009/0233532 | A1 * | 9/2009 | Togawa et al. | 451/288 |

FOREIGN PATENT DOCUMENTS

| | | | |
|---|---|---|---|
| JP | 2002-538611 | A | 11/2002 |
| JP | 2008-093811 | A | 4/2008 |
| JP | 2010-010213 | A | 1/2010 |
| JP | 2010-240767 | A | 10/2010 |

* cited by examiner

POLISHING HEAD CAPABLE OF CONTINUOUSLY VARYING PRESSURE DISTRIBUTION BETWEEN PRESSURE REGIONS FOR UNIFORM POLISHING

CROSS-REFERENCE TO RELATED APPLICATION

This application is based upon and claims the benefit of priority of the prior Japanese Patent Application No. P2010-193124, filed on Aug. 31, 2010, and the entire contents of which are incorporated herein by reference.

FIELD

The present invention relates to a polishing apparatus capable of precisely polishing a surface of a work.

BACKGROUND

These days, semiconductor devices have been highly integrated. Thus, highly-flat and high quality silicon wafers are required. In case of polishing interlayer insulating films and metal wires deposited on a surface of a wafer to produce semiconductor devices, the surface of the wafer must be more highly flattened. Therefore, a polishing apparatus capable of more accurately polishing a surface of a wafer as a mirror surface or highly precisely polishing the surface as a standard surface is required.

For example, a conventional wafer polishing apparatus has an airbag-type polishing head, which holds a wafer and presses the entire surface of the wafer onto a polishing pad of a polishing plate with uniform pressing force (see Japanese Laid-open Patent Publication No. 2002-187060).

According to claim 1 of said Japanese laid-open patent publication, the wafer polishing apparatus has a polishing head comprising: a top ring having a main body for holding a wafer; an elastic pad contacting the wafer; and a supporting member for supporting the elastic pad. A contact member having an elastic sheet, which contacts the elastic pad, is provided on a lower face of the supporting member. A first pressure chamber, which is located in an inner part of the contact member, and a second pressure chamber, which is located in an outer part of the contact member, are formed in a space between the elastic pad and the supporting member. A fluid supply source supplies a fluid to or vacuates the first and second pressure chambers.

In the polishing apparatus disclosed in said Japanese laid-open patent publication, the wafer is concentrically pressed by the first and second pressure chambers and the elastic pad. Therefore, the wafer can be uniformly polished by adjusting inner pressures of the first and second pressure chambers.

However, the inner pressures of the first and second pressure chambers are different, so pressure in a boundary area between the first and second pressure chambers must be discontinuous. Therefore, in the boundary area, the pressure distributes in a staircase pattern, and the surface of the wafer will be polished like a staircase.

In case of using the elastic pad composed of a softer material, the above described problem occurs remarkably.

SUMMARY

Accordingly, it is objects to provide a polishing apparatus capable of solving the above described problem of the conventional polishing apparatus. Namely, the polishing apparatus of the present invention is capable of continuously varying pressure distribution in a boundary area between concentric press regions and uniformly polishing a work.

To achieve the object, the present invention has following structures.

Namely, the polishing apparatus comprises:

a polishing head for holding a work;

a polishing plate having a polishing face, on which a polishing pad is adhered; and a driving mechanism for relatively moving the polishing head with respect to the polishing plate, and the polishing head includes:

a holding plate having a ring-shaped side wall;

an elastic sheet member being fixed to an edge of the holding plate, the elastic sheet member having a lower face, which is capable of pressing the work onto the polishing pad of the polishing plate;

a pressure chamber, to which a fluid at a prescribed pressure is supplied so as to press the elastic sheet member, being formed between a lower face of the holding plate and an upper face of the elastic sheet member;

a seal ring concentrically dividing the pressure chamber into chambers, the seal ring having a seal lip, which sidlingly contacts the elastic sheet member; and a fluid supply section for individually supplying the fluid to the divided chambers, which are divided by the seal ring.

Preferably, the polishing head further includes a fluid pressure control section for maintaining a differential pressure between the divided chambers with releasing the fluid in a prescribed direction from the divided chamber.

Preferably, the seal ring releases the fluid from the outer divided chamber to the inner divided chamber, or the seal ring releases the fluid from the inner divided chamber to the outer divided chamber.

Preferably, a plurality of the seal rings are concentrically provided so as to concentrically divide the pressure chamber into a plurality of the divided chambers.

Preferably, the elastic sheet member is a backing member composed of a resin sheet and a foaming resin layer formed on the resin sheet, the elastic sheet member covers a lower face of the holding plate and is fixed to the edge thereof, and the foaming resin layer constitutes the lower face of the elastic sheet member so that the foaming resin layer is capable of pressing the work onto the polishing pad of the polishing plate.

In the present invention, the polishing apparatus is capable of continuously varying pressure distribution in a boundary area between concentric press regions, so that the work can be highly uniformly polished.

BRIEF DESCRIPTION OF THE DRAWINGS

Embodiments of the present invention will now be described by way of examples and with reference to the accompanying drawings, in which.

DETAILED DESCRIPTION OF THE EMBODIMENTS

Preferred embodiments of the present invention will now be described in detail with reference to the accompanying drawings.

Figure 1:
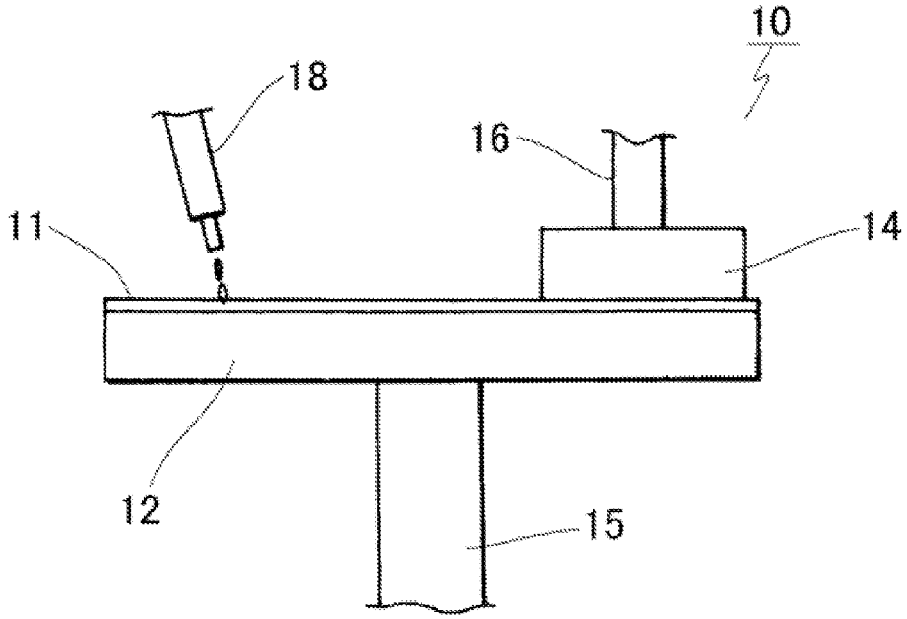
FIG. 1 is an explanation view of a polishing apparatus.

FIG. 1 is a schematic explanation view of a polishing apparatus 10 for polishing a work, e.g., semiconductor wafer.

The polishing apparatus 10 comprises: a polishing plate 12 having a polishing face, on which a polishing pad 11 for polishing the wafer is adhered; a polishing head 14 having a lower face, on which the wafer is held, and pressing the wafer onto the polishing pad 11; and a driving mechanism for relatively moving the polishing head 14 with respect to the polishing plate 12.

The driving mechanism includes: a first rotary driving unit (not shown) for rotating the polishing plate 12 about a rotary shaft 15; and a second rotary driving unit (not shown) for rotating the polishing head 14 about a rotary shaft 16. Further, the polishing head 14 has a vertical driving unit (not shown) and a horizontal driving unit (not shown). The polishing head 14 sucks and holds the wafer, which has been located at a wafer supply station, on the lower face, moves the wafer onto the polishing plate 12, and presses the wafer onto the polishing pad 11. In this state, the polishing plate 12 and the polishing head 14 are relatively rotated by the driving mechanism, so that a surface of the wafer can be polished. A slurry nozzle 18 supplies slurry onto the polishing pad 11.

Figure 2:
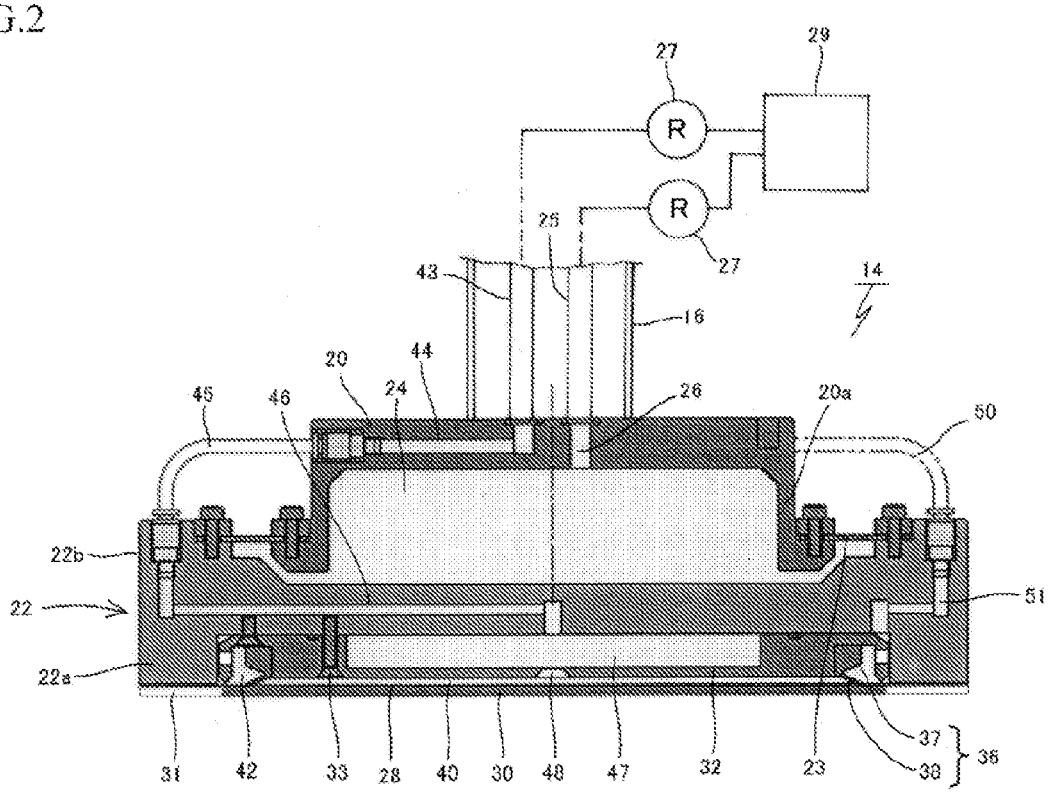
FIG. 2 is a sectional view of a polishing head.

FIG. 2 is a sectional view of the polishing head 14.

A cylindrical side wall 20*a* is downwardly extended from a main body 20 of the polishing head 14.

A holding plate 22 has a ring-shaped lower side wall 22*a* and a ring-shaped upper side wall 22*b*.

A ring-shaped diaphragm 23 is composed of hard rubber. An outer edge of the diaphragm 23 is fixed to an upper part of the upper side wall 22*b*; an inner edge of the diaphragm 23 is fixed to an outer edge of the side wall 20*a* of the main body 20. With this structure, the holding plate 22 can be moved upward and downward, in a prescribed range, with respect to the main body 20. Note that, the holding plate 22 may be connected to the main body 20, by pins (not shown), so as to limit downward movement of the holding plate 22.

A first pressure chamber 24 is constituted by a lower face of the main body 20, an upper face of the holding plate 22 and the diaphragm 23. A pressure fluid, e.g., compressed air, is supplied to the first pressure chamber 24 via a tube 25 provided in the rotary shaft 16 and a through-hole 26 formed in the main body 20. The tube 25 is connected to a fluid supply source 29 by a rotary joint (not shown) and a regulator (fluid pressure control section) 27. A first fluid supply section is constituted by the tube 25, the through-hole 26, the regulator 27, the fluid supply source 29, etc.

An elastic sheet member 28 covers a lower face of the holding plate 22. An outer edge of the elastic sheet member 28 is fixed on a lower face of the lower side wall 22*a* of the holding plate 22 by double-faced adhesive tape (not shown). Note that, the means for fixing the elastic sheet member 28 is not limited to double-faced adhesive tape. For example, the elastic sheet member 28 may be fixed by clamping the outer edge between a ring-shaped member (not shown) and the lower face of the lower side wall 22*a* and fixing the ring-shaped member to the lower side wall 22*a* with screws.

In the present embodiment, the elastic sheet member 28 is a two-layer sheet constituted by a rubber sheet and a backing member. Note that, the elastic sheet member 28 may be constituted by the backing member only. For example, the backing member is composed of a base layer, which is a resin sheet, e.g., PET film (not shown) and a foaming resin layer, e.g., urethane foam layer, formed on the resin sheet. The urethane foam layer is provided under the base layer so as to constitute the lower face of the elastic sheet member 28. In this state, the elastic sheet member 28 is fixed to the holding plate 22. The wafer 30 is held on the urethane foam layer by surface tension of water.

A ring-shaped plastic template 31 is fixed to an outer edge of the lower face of the elastic sheet member 28, which corresponds to the lower face of the lower side wall 22*a* of the holding plate 22.

A thickness of the template 31 is nearly equal to that of the wafer 30. The template 31 surrounds the wafer 30 so as to prevent the wafer 30 from jumping outside while polishing the wafer 30.

By supplying the fluid to the first pressure chamber 24, the template 31 presses a part of the polishing pad 11, which surrounds an outer edge of the wafer 30, while polishing the wafer 30. By making a height of a surface of the polishing pad 11 nearly equal to that of a lower face of the wafer 30, over-polishing the wafer 30 can be prevented.

A space surrounded by the elastic sheet member 28 and the lower side wall 22*a* of the holding plate 22 is formed under the holding plate 22, and a circular supporting plate 32 is fixed, by screws 33, in the space. A small clearance is formed between a lower face of the supporting plate 32 and an upper face of the elastic sheet member 28.

A rubber V-ring 36, which is an example of a seal ring, is constituted by a main body part 37 and a seal lip 38. The main body part 37 is fitted on an outer circumferential face of the supporting plate 32. The seal lip 38 sidelingly contacts the upper face of the elastic sheet member 28. With this structure, a second pressure chamber (inner divided chamber) 40 is constituted by the upper face of the elastic sheet member 28, a lower face of the supporting plate 32 and the V-ring 36. Further, a third pressure chamber (outer divided chamber) 42 is constituted by the upper face of the elastic sheet member 28, the lower side wall 22*a* and the V-ring 36.

The pressure fluid, e.g., compressed air, is supplied to the second pressure chamber 40 via a tube 43 provided in the rotary shaft 16, a fluid path 44 formed in the main body 20, a hose 45, a fluid path 46 formed in the holding plate 22, a concave part 47 of the supporting plate 32 and a through-hole 48. The tube 43 is connected to the fluid supply source 29 by a rotary joint (not shown) and another regulator 27. A second fluid supply section is constituted by the tube 43, the fluid paths 44 and 46, the hose 45, the concave part 47, the through-hole 48, another regulator 27, the fluid supply source 29, etc.

The pressure fluid, e.g., compressed air, is supplied to the third pressure chamber 42 via a tube (not shown) provided in the rotary shaft 16, a fluid path (not shown) formed in the main body 20, a hose 50 and a fluid path 51 formed in the holding plate 22. The tube (not shown) provided in the rotary shaft 16 is connected to the fluid supply source 29 by a rotary joint (not shown) and a regulator (not shown). A third fluid supply section is constituted by the tube, the hose 50, the fluid path 51, the through-hole 48, the regulator, the fluid supply source 29, etc.

The polishing apparatus of the present embodiment has the above described structure.

The wafer 30 is held on the lower face of the elastic sheet member 28 by surface tension of water.

The fluid at a prescribed pressure is supplied to the first pressure chamber 24 by the first fluid supply section while polishing the wafer 30. Therefore, the holding plate 22 is pressed onto the polishing pad 11 of the polishing plate 12. Especially, the template 31 is pressed onto the polishing pad 11 with a prescribed pressure so as to make the part of the polishing pad 11, which surrounds the wafer 30, level with the surface of the wafer 30. A fluid pressure in the first pressure chamber 24 is maintained at a prescribed pressure by the regulator 27.

A fluid at a prescribed pressure is supplied to the second pressure chamber 40 by the second fluid supply section. Further, a fluid at a prescribed pressure is supplied to the third pressure chamber 42 by the third fluid supply section.

In the present embodiment, basically, the pressure in the second pressure chamber 40 is higher than that in the third pressure chamber 42. Therefore, the seal lip 38 of the V-ring 36 is slightly opened, so that the fluid in the second pressure chamber 40 moves into the third pressure chamber 42. At that time, the regulator (fluid pressure control section) 27 allows the fluid in the second pressure chamber 40 to move into the third pressure chamber 42 and controls the fluid pressure so as to maintain the pressures of the both pressure chambers 40 and 42. Namely, the regulator 27 maintains a differential pressure between the both pressure chambers 40 and 42.

Since the fluid moves from the second pressure chamber 40 to the third pressure chamber 42, a pressure in a boundary area between the both pressure chambers 40 and 42 (press regions) continuously varies. Unlike the conventional apparatus in which the pressure in the boundary area discontinuously varies in a staircase pattern, the polishing apparatus 10 of the present embodiment is capable of uniformly polishing the surface of the wafer 30.

Note that, the pressure in the second pressure chamber 40 may be set lower than that in the third pressure chamber 42 according to polishing conditions. In this case, the seal lip 38 of the V-ring 36 is closed, so no fluid moves from the third pressure chamber 42 to the second pressure chamber 40.

In case of producing the differential pressure by the V-ring 36, even if no fluid moves, pressure distribution in the boundary area, which is formed immediately under the V-ring 36, can be slowly varied. Thus, the seal lip 38 is sidelingly set to obtain this effect, so that the surface of the wafer 30 can be uniformly polished.

An experiment performed in the polishing apparatus 10 will be explained. The wafer 30, whose diameter was 200 mm, was polished under the following conditions: (1) an inner diameter of the template 31 was about 200 mm; (2) an outer diameter of the supporting plate 32 was 170 mm; (3) a pressure of the second pressure chamber was 20 kPa; (4) a pressure of the third pressure chamber 42 was divided into five stages, i.e., −10/−5/±0/+5/+10 kPa with respect to the pressure of the second pressure chamber 40; (5) a load of the template 31 was 200 g/cm$^2$; and (6) rotational speeds of the polishing head 14 and the polishing plate 12 were 31 rpm.

Figure 3:
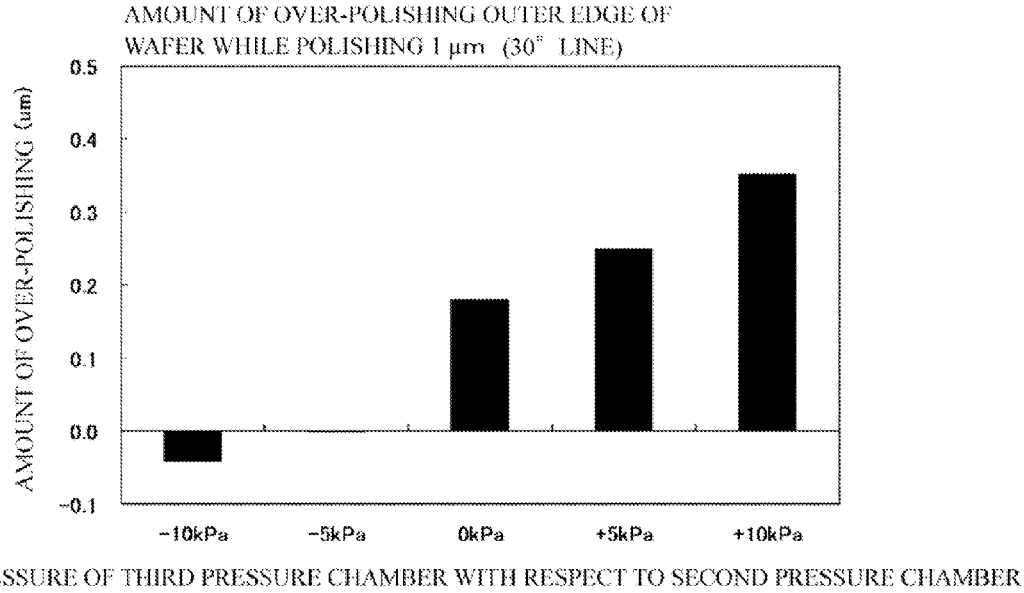
FIG. 3 is a graph showing a relationship between amount of over-polishing an outer edge of a wafer and pressure of a third pressure chamber with respect to that of a second pressure chamber.

An amount of over-polishing an outer circumferential face of the wafer 30, while performing the above described experiment, is shown in FIG. 3.

According to FIG. 3, an amount of polishing the wafer 30 was basically controlled by varying pressure difference between the second pressure chamber 40 and the third pressure chamber 42.

In the above described experiment, the amount of over-polishing was optimized, i.e., zero, when the pressure difference between the both pressure chambers 40 and 42 was −5 kPa. However, this pressure difference cannot be applied, as an optimum pressure difference, to all of polishing operations.

For example, an optimum pressure difference is varied by the position of the V-ring 36 with respect to the wafer 30 (a size of the supporting plate 32), i.e., the position of the boundary area between the second pressure chamber 40 and the third pressure chamber 42, etc.

In the present embodiment, the V-ring 36 is set to allow the fluid to move from the second pressure chamber 40 to the third pressure chamber 42. Note that, the V-ring 36 may be oppositely set to allow the fluid to move from the third pressure chamber 42 (outer chamber) to the second pressure chamber 40 (inner chamber). A type of the V-ring 36 is selected on the basis of a type of the wafer 30, a size of the polishing apparatus 10, polishing conditions, etc.

In the present embodiment, one V-ring 36 is provided to form the second pressure chamber 40 and the third pressure chamber 42, but number of the V-ring 36 is not limited to one. A plurality of the V-rings 36 may be concentrically provided to form three or more pressure chambers so as to precisely control the pressure for pressing the wafer 30.

In the polishing head 14 of the present embodiment, the wafer 30 is held by the backing member, but the wafer 30 may be held by other means, e.g., vacuum suction. In case of employing the vacuum suction means, the V-ring 36 may be provided on a sucking sheet which acts as the elastic sheet member.

Figure 4:
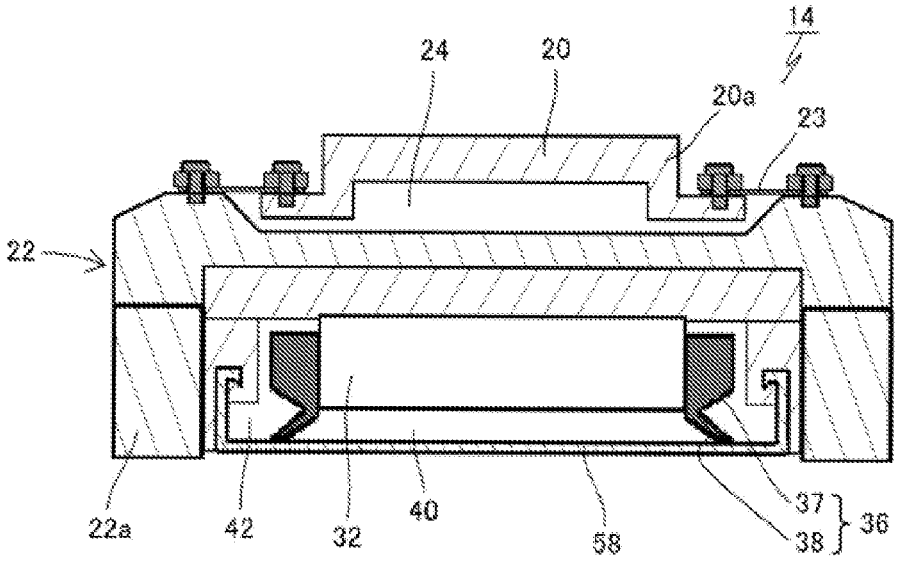
FIG. 4 is a schematic sectional view of the polishing head of another embodiment.

The polishing head 14 of another embodiment will be explained with reference to FIG. 4.

The holding plate 22 is suspended on the lower side of the main body 20 by the diaphragm 23, so that the holding plate 22 can be moved upward and downward. The first pressure chamber 24 is constituted by the lower face of the main body 20, the upper face of the holding plate 22 and the diaphragm 23. The holding plate 22 has the ring-shaped side wall 22*a*.

The circular supporting plate 32 is fixed in the holding plate 22. An elastic sheet member 58 covers the lower face of the supporting plate 32. An outer edge of the elastic sheet member 58 is fixed on the supporting plate 32. A small clearance is formed between the lower face of the supporting plate 32 and an upper face of the elastic sheet member 58.

The rubber V-ring 36, which is an example of the seal ring, is fitted on an outer circumferential face of the supporting plate 32. The seal lip 38 sidelingly contacts the upper face of the elastic sheet member 58. With this structure, the second pressure chamber 40 and the third pressure chamber 42 are formed on the lower side of the supporting plate 32.

A wafer (not shown) is sucked onto the elastic sheet member 58 by reducing inner pressure of the second pressure chamber 40, and the wafer is sucked and held on a lower face of the elastic sheet member 58 by sucker effect of the elastic sheet member 58. In this state, the wafer can be conveyed.

To polish the wafer, the wafer is conveyed to a position above the polishing plate 12, the fluid at a prescribed pressure is supplied, by a fluid supply section (not shown), to the first pressure chamber 24, the second pressure chamber 40 and the third pressure chamber 42, and the wafer is pressed onto the polishing pad 11 of the polishing plate 12 with prescribed pressing force. Then, the polishing plate 12 and the polishing head 14 are respectively rotated in prescribed directions, so that the wafer can be polished.

The wafer is surrounded by the ring-shaped side wall (retainer ring) 22*a* of the holding plate 22, so the wafer does not jump outside from the polishing head 14 while polishing the wafer. A part of the polishing pad 11, which surrounds an outer edge of the wafer, is pressed by a lower face of the side wall 22*a*, so that over-polishing the outer edge of the wafer can be prevented.

In this embodiment too, the fluid moves from the second pressure chamber 40 to the third pressure chamber 42, a pressure in the boundary area between the both pressure chambers 40 and continuously varies. Therefore, unlike the conventional apparatus in which the pressure in the boundary area discontinuously varies in a staircase pattern, the polishing apparatus 10 of the present embodiment is also capable of uniformly polishing the surface of the wafer.

In this embodiment, the supporting plate 32 is fixed in the holding plate 22. Further, the supporting plate 32 may be suspended, by a diaphragm (not shown), to move upward and downward, a fourth pressure chamber (not shown) may be constituted by the lower face of the holding plate 22, the upper face of the supporting plate 32 and the diaphragm, and the fluid at a prescribed pressure may be supplied to the fourth pressure chamber, by a fluid supply section. Namely, the wafer may be polished with applying the pressing force, from the pressure chambers, in multiple stages.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention has been described in detail, it should be understood that the various changes, substitutions, and alternations could be made hereto without departing from the spirit and scope of the invention.

What is claimed is:

1. A polishing apparatus, comprising:

a polishing head for holding a work;

a polishing plate having a polishing face, on which a polishing pad is adhered; and a driving mechanism for relatively moving the polishing head with respect to the polishing plate, wherein the polishing head includes:

a holding plate having a ring-shaped side wall and a supporting plate surrounded by the ring-shaped side wall;

an elastic sheet member being fixed to an edge of the holding plate, the elastic sheet member having a lower face, which is capable of pressing the work onto the polishing pad of the polishing plate;

a ring-shaped template being fixed to an outer edge part of the lower face of the elastic sheet member, the ring-shaped template surrounding the work so as to hold the work and prevent the work from jumping outside while polishing the work;

a pressure chamber, to which a fluid at a prescribed pressure is supplied so as to press the elastic sheet member, being formed between a lower face of the holding plate and an upper face of the elastic sheet member;

a seal ring, which is composed of rubber and which has a V-shaped section, having a main body part, which is fitted on the supporting plate, the seal ring sidelingly contacting the elastic sheet member so as to divide the pressure chamber into an inner chamber and an outer chamber; and a fluid supply section for individually supplying the fluid to the inner and outer chambers, which are divided by the seal ring.

2. The polishing apparatus according to claim 1, wherein the polishing head further includes a fluid pressure control section for maintaining a differential pressure between the divided chambers with releasing the fluid in a prescribed direction from the divided chamber.

3. The polishing apparatus according to claim 2, wherein the seal ring releases the fluid from the outer divided chamber to the inner divided chamber.

4. The polishing apparatus according to claim 2, wherein the seal ring releases the fluid from the inner divided chamber to the outer divided chamber.

5. The polishing apparatus according to claim 4, wherein a plurality of the seal rings are concentrically provided so as to concentrically divide the pressure chamber into a plurality of the divided chambers.

6. The polishing apparatus according to claim 2, wherein a plurality of the seal rings are concentrically provided so as to concentrically divide the pressure chamber into a plurality of the divided chambers.

7. The polishing apparatus according to claim 2, wherein the elastic sheet member is a backing member composed of a resin sheet and a foaming resin layer formed on the resin sheet, the elastic sheet member covers a lower face of the holding plate and is fixed to the edge thereof, and the foaming resin layer constitutes the lower face of the elastic sheet member so that the foaming resin layer is capable of pressing the work onto the polishing pad of the polishing plate.

8. The polishing apparatus according to claim 1, wherein the seal ring releases the fluid from the outer divided chamber to the inner divided chamber.

9. The polishing apparatus according to claim 1, wherein the seal ring releases the fluid from the inner divided chamber to the outer divided chamber.

10. The polishing apparatus according to claim 9, wherein a plurality of the seal rings are concentrically provided so as to concentrically divide the pressure chamber into a plurality of the divided chambers.

11. The polishing apparatus according to claim 1, wherein a plurality of the seal rings are concentrically provided so as to concentrically divide the pressure chamber into a plurality of the divided chambers.

12. The polishing apparatus according to claim 1, wherein the elastic sheet member is a backing member composed of a resin sheet and a foaming resin layer formed on the resin sheet, the elastic sheet member covers a lower face of the holding plate and is fixed to the edge thereof, and the foaming resin layer constitutes the lower face of the elastic sheet member so that the foaming resin layer is capable of pressing the work onto the polishing pad of the polishing plate.

* * * * *